United States Patent [19]

MacRae et al.

[11] 4,099,958

[45] Jul. 11, 1978

[54] METHOD OF PRODUCING VANADIUM

[75] Inventors: Donald R. MacRae, Bethlehem; Richard G. Gold, Coopersburg; William R. Sandall; Charles D. Thompson, both of Bethlehem, all of Pa.

[73] Assignee: Bethlehem Steel Corporation, Bethlehem, Pa.

[21] Appl. No.: 675,672

[22] Filed: Apr. 9, 1976

[51] Int. Cl.[2] ..... C22F 1/02; C22B 34/22; C22C 1/04

[52] U.S. Cl. ..... 75/0.5 BA; 75/0.5 BB; 75/84

[58] Field of Search ..... 75/0.5 B, 0.5 BB, 0.5 BA, 75/10 R, 10 C, 10 P, 10 V, 11, 84; 423/592; 204/164

[56] References Cited

U.S. PATENT DOCUMENTS

| | | | |
|---|---|---|---|
| 2,702,739 | 2/1955 | Kelly, Jr. | 423/592 |
| 2,776,871 | 1/1957 | Kelly, Jr. | 423/592 |
| 3,101,308 | 8/1963 | Sheer et al. | 204/164 |
| 3,334,992 | 8/1967 | Downing et al. | 75/0.5 BB |
| 3,765,870 | 10/1973 | Fey et al. | 75/11 |
| 3,997,333 | 12/1976 | Fey | 75/84 |
| 4,002,466 | 1/1977 | MacRae et al. | 75/11 |

OTHER PUBLICATIONS

Mah, A. D., Thermodynamic Properties of Vanadium and Its Compounds, U.S. Bureau of Mines Report of Investigations, 6727, pp. 39–44 (1966).

Rostocker, W. The Metallurgy of Vanadium, J. Wiley & Sons (1958), pp. 7–16.

*Primary Examiner*—R. Dean
*Assistant Examiner*—Michael L. Lewis
*Attorney, Agent, or Firm*—Joseph J. O'Keefe; Michael J. Delaney; John I. Iverson

[57] ABSTRACT

Vanadium oxides are reduced to the metallic state by reaction with carbon in a plasma arc torch.

3 Claims, 2 Drawing Figures

METHOD OF PRODUCING VANADIUM

BACKGROUND OF THE INVENTION

This invention relates to a method of producing vanadium and alloys thereof. More particularly, it relates to such a method one step of which includes the reducing of vanadium oxides in a plasma arc torch.

In the past, vanadium and alloys thereof, e.g. ferrovanadium, have been produced in an electric arc furnace by reducing vanadium oxides in the high temperature zone between two or more graphite electrodes submerged in a bath containing vanadium oxides and a reductant such as carbon. Fluxes and steel scrap or iron were also present in the bath, if desired.

Vanadium was also produced by heating vanadium oxides under vacuum and in the presence of carbon in an electric resistance furnace. This process was carried out in batches and a relatively long times, e.g. several hours.

As described in U.S. Pat. No. 2,709,739 to J. C. R. Kelley, Jr. vanadium metal powder was also produced by first reducing vanadium pentoxide to vanadium trioxide. In order to avoid a hard end product having poor ductility, it was essential to reduce the pentoxide in a moist atmosphere at relatively low temperatures, e.g. 450° to 650° C. (840° to 1200° F.). The resultant trioxide was subsequently reduced to the pure metal by reacting the trioxide with calcium in a metal bomb.

In an effort to produce vanadium and alloys thereof in a more rapid and substantially continuous process, attempts have been made to reduce vanadium pentoxide in a plasma arc torch. However, such attempts have at times proved unsuccessful, as the inlet ports of the torch inevitably became clogged, thereby blocking entry of additional vanadium pentoxide.

U.S. Pat. No. 3,765,870 to Maurice G. Fey et al. discloses that vanadium may be produced by reducing vanadium oxides in a plasma arc torch with hydrocarbon radicals. Fey et al. do not disclose which vanadium oxides may be reduced by these radicals. They do disclose that carbon ions and atoms are not effective in reducing such oxides.

It is an object of this invention to provide a process for producing vanadium and alloys thereof in which vanadium oxides are reduced rapidly and with a very high yield.

SUMMARY OF THE INVENTION

We have discovered that, contrary to the teachings of Fey et al., the above object can be obtained by introducing vanadium oxides and a carbonaceous substance such as coke into a plasma arc torch whereby the carbon in this substance reduces these oxides. Furthermore, we have discovered that vanadium can be produced by partially reducing a first mixture of solid particles comprising primarily vanadium pentoxide into a second mixture of solid particles comprising primarily a vanadium oxide having a melting point higher than that of vanadium pentoxide. For example, the pentoxide may be reduced to the tetroxide, the trioxide, or mixtures thereof. This partial reduction changes the melting point of the mixture from about 690° C. (1270° F.), which is the melting point of vanadium pentoxide, to about 1970° C. (3580° F.), which is the melting point of vanadium trioxide and approximately that of vanadium tetroxide. A stabilizing gas stream is intorduced adjacent the cathode of a plasma arc torch comprising a cathode and an anode. The second mixture of solid particles is introduced into the torch between the ends of the anode, nd an arc is established between the cathode and the anode. A reductant is then reacted with the vanadium oxides in the second mixture of solid particles. The products of the reaction between the reductant and the vanadium oxides leave the torch and are collected in a receiving vessel.

DESCRIPTION OF THE PREFERRED EMBODIMENT

Figure 1:
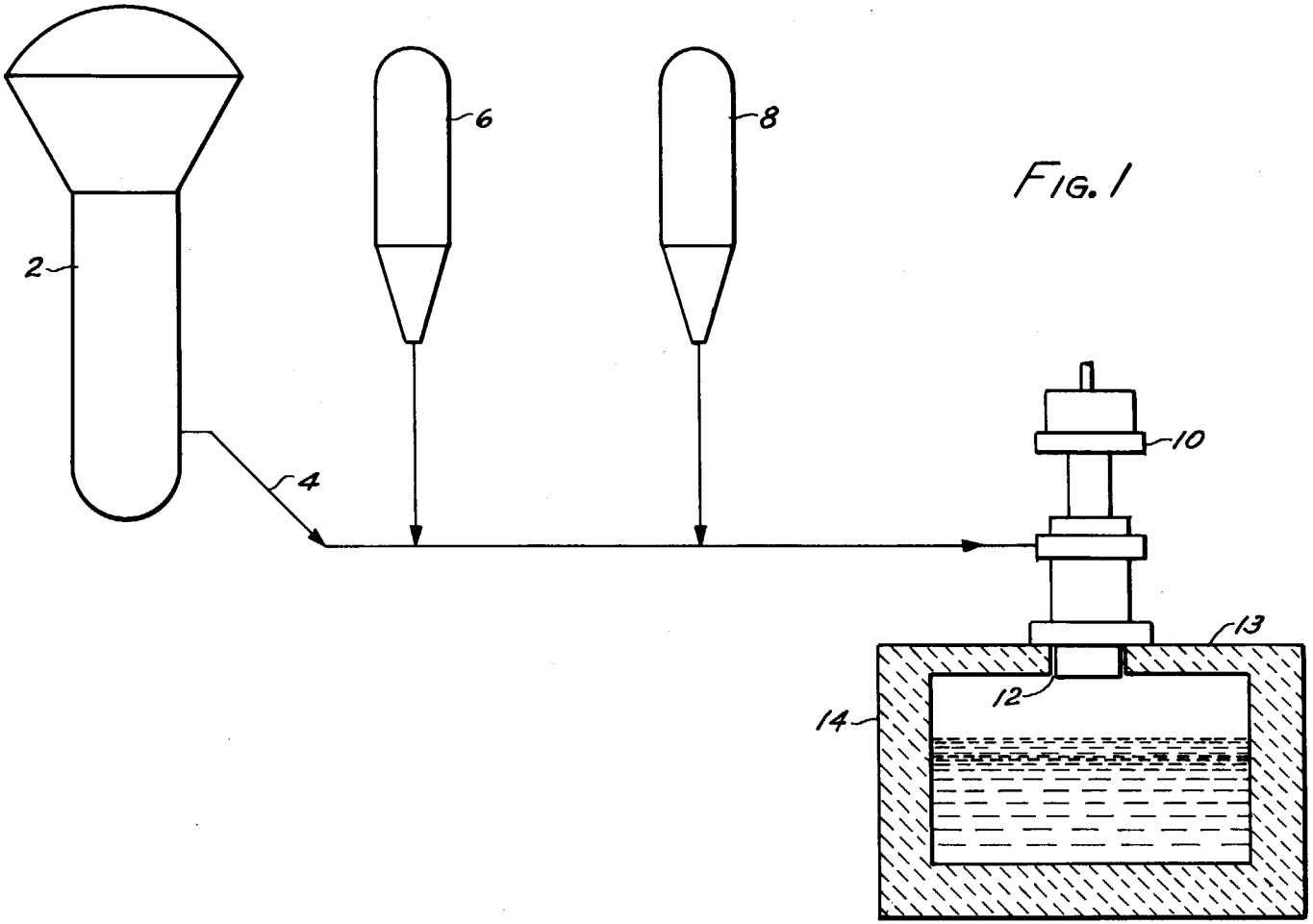
FIG. 1 is a flow diagram of a process of the invention.

As shown in FIG. 1, a fluidized bed reactor 2 is adapted to receive a charge of a mixture of solid vanadium oxide particles comprising primarily vanadium pentoxide. For example, a typical mixture consists of over 98% vanadium pentoxide. The particles of vanadium pentoxide are partially reduced in the reactor 2 by a reducing gas, e.g. hydrogen. Following this reduction, the particles comprise primarily vanadium trioxide. However, some of the particles are reduced to a lesser extent and form vanadium tetroxide. In addition, in the case of some of the particles, only the shell thereof may be reduced while the interior of the particles remains vanadium pentoxide. In general, the partially reduced particles have a vanadium content of 65 to 67%, whereas substantially pure vanadium trioxide has a vanadium content of 68%.

The partially reduced particles are fed pneumatically through a blending tube 4 wherein additional materials, e.g. iron powder from a feeder 6 and carbon from a feeder 8, are added to the output from the reactor 2 and thoroughly mixed. The output from the blending tube 4 is fed to a plasma arc torch 10 wherein the reduction of the vanadium oxides is substantially completed. The plasma arc torch 10 is secured in an annular opening 12 in the roof 13 of a crucible 14.

Although it is not essential for iron powder to be present in the feed, it is preferred, as the inclusion of iron serves to lower the melting point of the mix. Hence, torches operating at lower enthalpies may be used to produce a liquid product. Otherwise, it may be necessary to provide the crucible with auxiliary heating sources to maintain the torch output in a liquid state or provide iron directly to the curcible to produce a lower melting point liquid.

Figure 2:
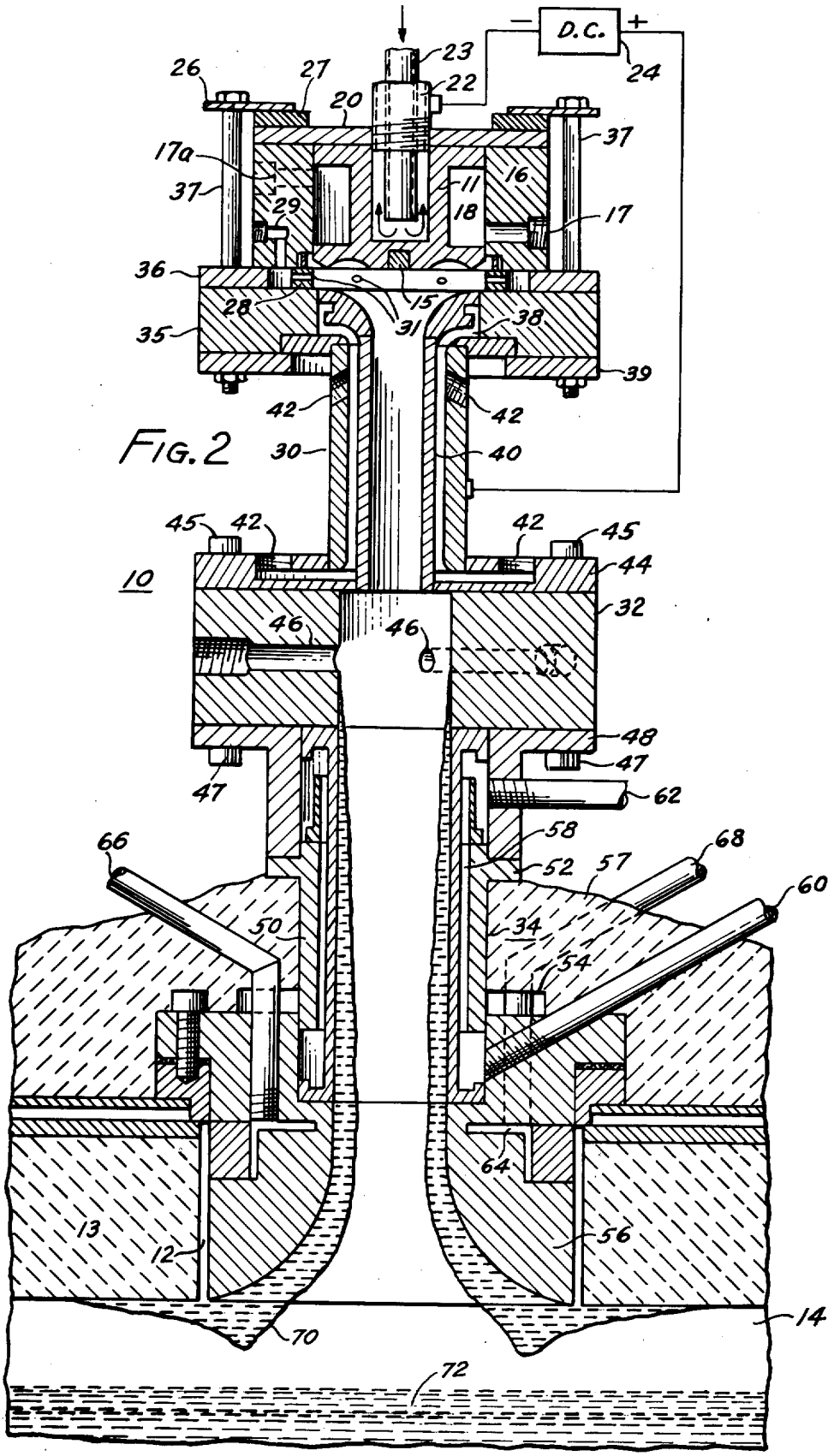
FIG. 2 is a diagrammatic view of a plasma arc torch that can be used in the subject process.

Referring more particularly to FIG. 2, the torch 10 is annular in cross section and broadly comprises a cathode section and an anode section. The cathode section comprises a copper annulus 11 having a thoriated tungsten button 15 therein to provide a point of arc attachment. The annulus 11 is disposed within an annular insulating block 16 and forms a passageway 18 therewith for the circulation of a coolant that enters the block 16 through a bore hole 17 and exits through a bore hole 17a. The block 16 is provided with a conductive cover plate 20 in which a conduit 22 is threaded. The conduit 22 is provided with an inner conduit 23, coaxial therewith, through which a coolant is provided to the interior of the annulus 11, the coolant leaving the annulus 11 through the conduit 22. The negative side of a source 24 of d.c. power, e.g. a 500 volts, 1000 ampere source, is connected directly to the conduit 22.

A gas ring 28 is provided immediately below the cathode section whereby a stabilizing gas, nonreactive with thoriated tungsten, can be introduced tangentially into the cathode region of the torch 10. This gas may be helium, hydrogen, argon, nitrogen or mixtures thereof, and flows vortically within the cathode section and downwardly along the walls of the torch. The block 16 is provided with a passageway 29 through which the gas passes to a plurality of ports 31 in the ring 28.

Disposed below the gas ring 28 is the anode section. This section broadly comprises an upper anode 30, an ore feed ring 32, and a lower anode 34. The top of the upper anode 30 is disposed within an annular insulating block 35 that is separated from the block 16 by means of a spacer ring 36. The blocks 16 and 35 are held together by tie bolts 37 passing through nylon insulating ring 27 and annular holding plates 26 and 39. The upper anode 30 is provided with passageways 38 and 40 to which a coolant may be supplied through conduits 42, for example.

The upper anode 30 is provided with a bottom flange 44 that is secured to the top of the ore feed ring 32 by machine screws 45. The ore feed ring 32 is provided with a plurality of passages 46 through which the mixture of higher melting point vanadium oxides, a reductant such as carbon, and iron powder, if desired, may be tangentially fed into the torch 10.

The lower anode 34 is provided with an annular flange 48 that is secured to the bottom of the ore feed ring by machine screws 47. The lower anode 34 comprises a tubular section 50 provided with spacer rings 52 and 54 and a contoured throat section 56. The section 50 is provided with an annular passageway 58 through which a coolant circulates via inlet tube 60 and exit tube 62. Similarly, the throat section 56 is provided with an annular passageway 64 through which a coolant circulates via inlet tube 66 and exit tube 68. The lower anode 34 is sealed to the roof 13 of the crucible 14 by means of a refractory 57, e.g. Permanente.

The subject process is practiced substantially as follows.

Vanadium oxides, comprising primarily vanadium pentoxide, are partially reduced in the fluidized bed reactor 2. This is accomplished by passing hydrogen through the oxides for several hours after the oxides have been heated to about 593° C. (1100° F.). For example, 68 kilograms (150 pounds) of fine granular vanadium pentoxide (8% plus 50 mesh and 95% plus 400 mesh) are placed in a reactor 0.305 meters (12 inches) in diameter and 1.68 meters (5.5 feet) high. A gas mixture consisting of 12,744 SLH (450 SCFH) of hydrogen and 1841 SLH (65 SCFH) of nitrogen is passed through the reactor with the temperature therein varying between 482° C. (900° F.) and 649° C. (1200° F.). (The initials SLH stand for "Standard liters per hour", which is the rate of flow of a volume of gas under standard conditions of 22° C. (70° F.) and one atmosphere of pressure. Similarly, SCFH stands for "Standard cubic feet per hour".) After 2 hours and 20 minutes on hydrogen, the partial reduction is completed and the reactor yields 49 kilograms (108 pounds) of partially reduced vanadium oxides comprising primarily vanadium trioxide. A cyclone on the gas exit from the reactor collects 7 kilograms (15.4 pounds) of material that is partially reduced in a fixed bed reactor and mixed in with the fluid bed product.

A primary stabilizing gas consisting of 60,039 SLH (2120 SCFH) of hydrogen and 47,012 SLH (1660 SCFH) of argon is then supplied to the cathode area of the plasma arc torch. This gas is nonreactive with the thoriated tungsten cathode and permits the production of extremely high gas temperatures with high enthalpies.

The partially reduced oxides are then fed through the blending tube 4, mixed with the output from the iron powder feeder 6 and the carbon feeder 8, and fed to the plasma arc torch 10. Typically, a blend may consist of 63% vanadium oxides (primarily vanadium trioxide), 17% iron powder, and 20% finely ground coke. This blend may be carried through the tube 4 by 11,328 SLH (400 SCFH) of argon.

The stabilizing gas is then fed through the gas ring 28 and forms a vortex moving downwardly along the walls of the torch. Typically, the gas may comprise a mixture of 60,039 SLH (2120 SCFH) of hydrogen and 47,012 SLH (1660 SCFH) of argon.

The blended mixture of vanadium oxides, iron powder and coke enters the torch through the passages 46 and becomes entrained in the stabilizing gas. An arc is then struck between the cathode button 15 and one of the anodes 30 and 34. The resultant plasma generates sufficient heat to reduce the vanadium oxides substantially completely to vanadium metal. The blended mixture may become completely molten, as shown at 70 in FIG. 2, although it also may become only partially molten, i.e., sintered. Due to the vortical action of the stabilizing gas, the mixture swirls about the walls of the lower anode 34 and only slowly descends. This slow descent results in a relatively long time during which the mixture is exposed to the heat of the plasma, thereby insuring a high degree of reduction of the oxide, a low rate of power consumption per unit of oxide reduced, and a high degree of reductant utilization.

Furthermore, the blended mixture on the walls of the anode protects the lower anode 34 from erosion by the arc. In addition, this mixture serves as a thermal insulator and decreases the heat loss to the cooling water flowing about the anode.

The products of the reaction between the reductant and the vanadium oxides leave the torch and fall into the crucible 14. The plasma penetrates the bath 72 in the curcible 14, thereby agitating the bath and further reducing any oxides which may still be present.

As an example of the invention, a test was run in a nominal 500 kilowatt torch. It was necessary to protect the refractory lining of the crucible 14 from erosion by the arc during preheating of the curcible. To this end, 27 kilograms of iron were premelted by the plasma torch to provide a bath of molten iron in the crucible before any vanadium oxides were introduced into the torch.

In this test 121.0 kilograms/hour (266 pounds/hour) of partially reduced vanadium oxides 32.9 kilograms/hour (72.5 pounds/hour) of carbon, and 32.2 kilograms/hour (71 pounds/hour) of iron powder were introduced into the torch. The same stabilizing gas and flow rate above referred to were used, and an arc was established between the cathode and the anode in the conventional manner. A current of 998 amperes and a voltage of 416 volts were established, resulting in a plasma enthalpy of 4644 kwh/MSL (164 kwh/MSCF) of equivalent hydrogen.

The enthalpy is expressed in kilowatt hours per thousand standard liters or cubic feet of equivalent hydrogen, the equivalent hydrogen in this case being the volume of argon in the stabilizing gas multiplied by 0.2 and added to the volume of hydrogen in the stabilizing gas. (The 0.2 multiplier is used because, in the temperate range used, argon can be heated to the same temperature as hydrogen with about one-fifth of the energy).

Ferrovanadium, containing 51% vanadium, was produced at a rate of 142 kg/hr. (312.5 pounds/hr.).

In another test, 37.8 kilograms/hour (83 pounds/-hour) of partially reduced vanadium oxides and 9.89 kilograms/hour (21.8 pounds/hour) of coke were introduced into a 100 kw torch. A stabilizing gas consisting of 12,461 SLH (440 SCFH) of hydrogen and 11,186 SLH (395 SCFH) of argon was supplied to the torch, while the vanadium oxides and coke were conveyed to the torch by 4,672 SLH (165 SCFH) of argon. An arc was established between the cathode and the anode in the conventional manner, resulting in a current of 565 amperes, a voltage of 221 volts, and a plasma enthalpy of 6400 kwh/MSL (226 kwh/MSCF) of equivalent hydrogen.

Vanadium-alloy containing 79% vanadium was produced at a rate of 28.4 kg/hr. (62.5 pounds/hr.).

As used herein, unless otherwise stated, all percentages are by weight.

We claim:

1. A method of producing vanadium and alloys thereof, comprising:

(a) introducing a blended dispersal of discrete particles of vanadium oxides and a carbonaceous substance into a plasma arc torch, (b) establishing an arc in said torch to at least partially melt said blended particles together, and (c) causing said blended, at least partially melted particles to slowly descend along the walls of said torch whereby the carbon in said carbonaceous substance reduces said vanadium oxides substantially completely to vanadium metal.

2. A method as recited in claim 1, in which said carbonaceous substance is coke.

3. A method of producing vanadium and alloys thereof, comprising:

(a) partially reducing a first mixture of solid particles comprising primarily vanadium pentoxide into a second mixture of solid particles comprising primarily a higher melting point vanadium oxide in which iron powder is added to said second mixture of solid particles to lower the melting point of said second mixture;

(b) supplying a stabilizing gas stream adjacent the cathode of a plasma arc torch comprising a cathode and an anode;

(c) introducing said second mixture of solid particles into said torch between the ends of said anode, establishing an arc between said cathode and said anode, and reacting a reductant with the vanadium oxides in said second mixture of particles; and (d) recovering vanadium and alloys thereof.

* * * * *